US010555384B2

(12) United States Patent
Chang et al.

(10) Patent No.: US 10,555,384 B2
(45) Date of Patent: Feb. 4, 2020

(54) MODULAR MICROWAVE POWER SUPPLY

(71) Applicant: Industrial Technology Research Institute, Hsinchu (TW)

(72) Inventors: Chih-Chen Chang, New Taipei (TW); Kun-Ping Huang, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 661 days.

(21) Appl. No.: 15/208,615

(22) Filed: Jul. 13, 2016

(65) Prior Publication Data

US 2017/0303347 A1 Oct. 19, 2017

(30) Foreign Application Priority Data

Apr. 15, 2016 (TW) ..... 105111744 A

(51) Int. Cl.
*H05B 6/66* (2006.01)
*H05B 6/68* (2006.01)

(52) U.S. Cl.
CPC ..... *H05B 6/664* (2013.01); *H05B 6/662* (2013.01); *H05B 6/68* (2013.01); *H05B 2206/043* (2013.01); *H05B 2206/044* (2013.01)

(58) Field of Classification Search
CPC ... H05B 6/664; H05B 6/662; H05B 2206/004
USPC ..... 219/715, 750, 757, 760; 315/105, 209 R, 315/219, 277
See application file for complete search history.

(56) References Cited

U.S. PATENT DOCUMENTS 3,651,371 A 3/1972 Tingley
3,760,291 A * 9/1973 Levinson ..... H03B 9/10 219/750
4,017,702 A * 4/1977 Harmon ..... H05B 6/666 219/715
4,175,246 A * 11/1979 Feinberg ..... H03B 9/10 315/101

(Continued)

FOREIGN PATENT DOCUMENTS

CN 201897249 7/2011
CN 202121521 1/2012

(Continued)

OTHER PUBLICATIONS

Hiroyuki Mori, et al., "A Parallel Tabu Search Based Method for Determining Optimal Allocation of FACTS in Power Systems," PowerCon 2000. 2000 International Conference on Power System Technology. Proceedings, vol. 2, Dec. 4-7, 2000, pp. 1077-1082.

(Continued)

*Primary Examiner* — Thien S Tran
(74) *Attorney, Agent, or Firm* — JCIPRNET

(57) ABSTRACT

A modular microwave power supply comprises a plurality of microwave power supply modules and a plurality of isolating diodes. To upgrade the output power of the modular microwave power supply, the plurality of microwave power supply modules are connected isolatively in common to a magnetron load by the plurality of isolating diodes, such that power combining of the plurality of microwave power supply modules is achieved, and the efficiency as well as the accumulated-heat dissipating ability of the modular microwave power supply are as good as each of the plurality of microwave power supply modules.

3 Claims, 11 Drawing Sheets

101

(56) References Cited

U.S. PATENT DOCUMENTS

| | | | | |
|---|---|---|---|---|
| 4,868,509 | A | 9/1989 | Ury et al. | |
| 5,451,750 | A | 9/1995 | An | |
| 6,049,071 | A | 4/2000 | Le Van Suu | |
| 6,320,171 | B1 * | 11/2001 | Kim | H05B 6/6402 126/21 A |
| 2015/0012151 | A1 | 1/2015 | Park | |

FOREIGN PATENT DOCUMENTS

| | | | |
|---|---|---|---|
| CN | 103200722 | | 7/2013 |
| CN | 203800840 | | 8/2014 |
| DE | 3941055 | | 6/1990 |
| DE | 3941055 | A1 * | 6/1990 |
| EP | 2315496 | | 4/2011 |
| TW | 409174 | | 10/2000 |
| TW | 201233250 | | 8/2012 |
| TW | M508845 | | 9/2015 |
| TW | 201541826 | | 11/2015 |

OTHER PUBLICATIONS

Xun Liu, et al., "Optimal Operation of Contactless Transformers with Resonance in Secondary Circuits," APEC 2008. Twenty-Third Annual IEEE Applied Power Electronics Conference and Exposition, Feb. 24-28, 2008, pp. 645-650.

S.Y.R. Hui, et al., "Optimal Operation of Coreless PCB Transformer-Isolated Gate Drive Circuits With Wide Switching Frequency Range," APEC '99. Fourteenth Annual Applied Power Electronics Conference and Exposition, vol. 2, Mar. 14-18, 1999, pp. 1196-1202.

Zhihong Ye, et al., "Control of Circulating Current in Two Parallel Three-Phase Boost Rectifiers," IEEE Transactions on Power Electronics, vol. 17, No. 5, Sep. 2002, pp. 609-615.

Takao Kawabata, et al., "Parallel Operation of Voltage Source Inverters," IEEE Transactions on Industry Applications, vol. 24. No. 2. Mar./Apr. 1988, pp. 281-287.

Josep M. Guerrero, et al., "Decentralized Control for Parallel Operation of Distributed Generation Inverters Using Resistive Output Impedance," IEEE Transactions on Industrial Electronics, vol. 54, No. 2, Apr. 2007, pp. 994-1004.

"Office Action of Taiwan Counterpart Application", dated Nov. 28, 2016, p. 1-p. 4, in which the listed references were cited.

"Search Report of Europe Counterpart Application", dated Jul. 20, 2017, p. 1-p. 7, in which the listed references were cited.

* cited by examiner

MODULAR MICROWAVE POWER SUPPLY

CROSS-REFERENCE TO RELATED APPLICATION

This application claims the priority benefits of a Taiwan application serial No. 105111744, entitled "MODULAR MICROWAVE POWER SUPPLY" and filed on 15 Apr. 2016. The entirety of the above-mentioned application is hereby incorporated by reference herein.

TECHNICAL FIELD

The technical field relates to a modular microwave power supply.

BACKGROUND

If the maximal power output of a microwave power supply is upgraded, the working temperature of the transformer in the microwave power supply will usually be higher because it accumulates more heat. It is crucial to dissipate the more accumulated heat for maintaining the transformer in an appropriate working temperature. The maximal power output of a microwave power supply is proportional to the volume of the transformer, while the heat-dissipating ability is proportion to the surface area of the transformer. Therefore, the ratio of maximal power output to heat-dissipating ability is equal to the ratio of volume to surface area of the transformer and thus is proportional to 1-dimensional size of the transformer, instead of an invariable number. As a result, the higher maximal power output of the transformer causes the larger size and the weaker heat-dissipating ability. To solve the heat-dissipating problem, this present disclosure relates to a simple way to upgrade the maximal power output of a microwave power supply such that its heat-dissipating ability and efficiency are as good as before upgrading.

SUMMARY

An embodiment of the disclosure relates to a modular microwave power supply. The modular microwave power supply comprises a plurality of microwave power supply modules and a plurality of isolating diodes. Each of the microwave power supply modules comprises a ferro-resonant transformer, a resonant capacitor connected in series to the ferro-resonant transformer, and a rectifier diode connected in parallel to the resonant capacitor. Each of the plurality of microwave power supply modules respectively connects to an electrode of one of the plurality of isolating diodes. And, the other electrodes of all the plurality of isolating diodes are connected in common to a magnetron load.

According to an embodiment of the disclosure, the plurality of single microwave power supply modules are isolatively connected in common to a magnetron load and combined into the modular microwave power supply with a combined-power output.

The foregoing will become better understood from a careful reading of a detailed description provided herein below with appropriate reference to the accompanying drawings.

DETAILED DESCRIPTION OF DISCLOSED EMBODIMENTS

Figure 1A:
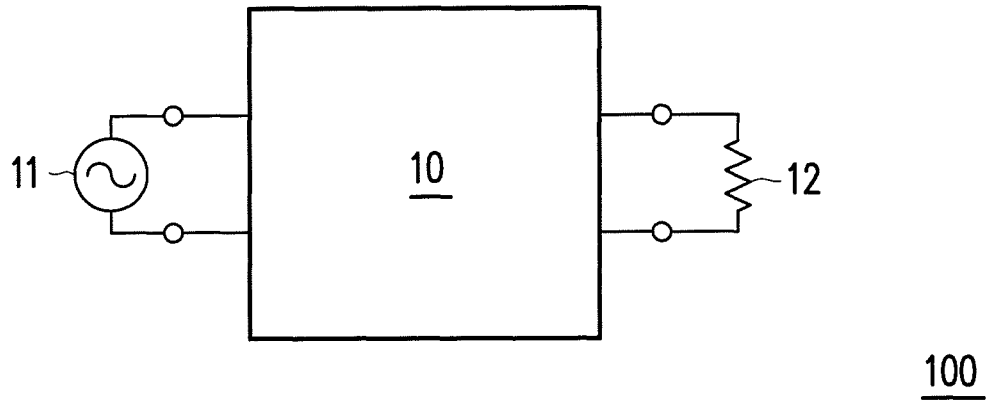
FIG. 1A and FIG. 1B are circuit configurations illustrating a microwave power supply module in brief and in detail respectively, in accordance with embodiments of the present disclosure.

Below, exemplary embodiments will be described in detail with reference to accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

In order to dissipate the accumulated-heat and keep high-efficient performance of a microwave power supply with an upgraded high-power output, the present disclosure provides a modular microwave power supply composed of a plurality of microwave power supply modules. This technique will not change the ratio of volume to surface area of the transformers within the modular microwave power supply after upgrading so as to ensure that not only the heat-dissipating ability but the efficiency of the modular one are as good as a single module. In addition, the single microwave power supply module is suitable for mass production. Therefore, the ratio of price to performance (CP ratio) of the single module can be optimized. As a result, after upgrading the output power of the modular microwave power supply by methods of the present disclosure, an optimized CP ratio of a single module remains.

Figure 1B:
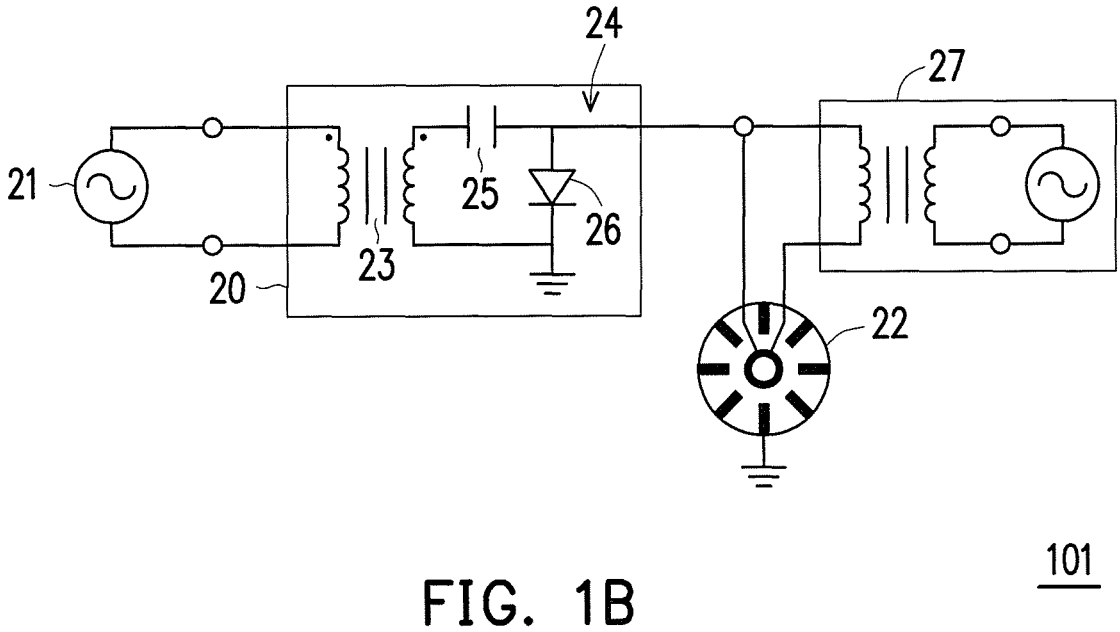
Figure 1C:
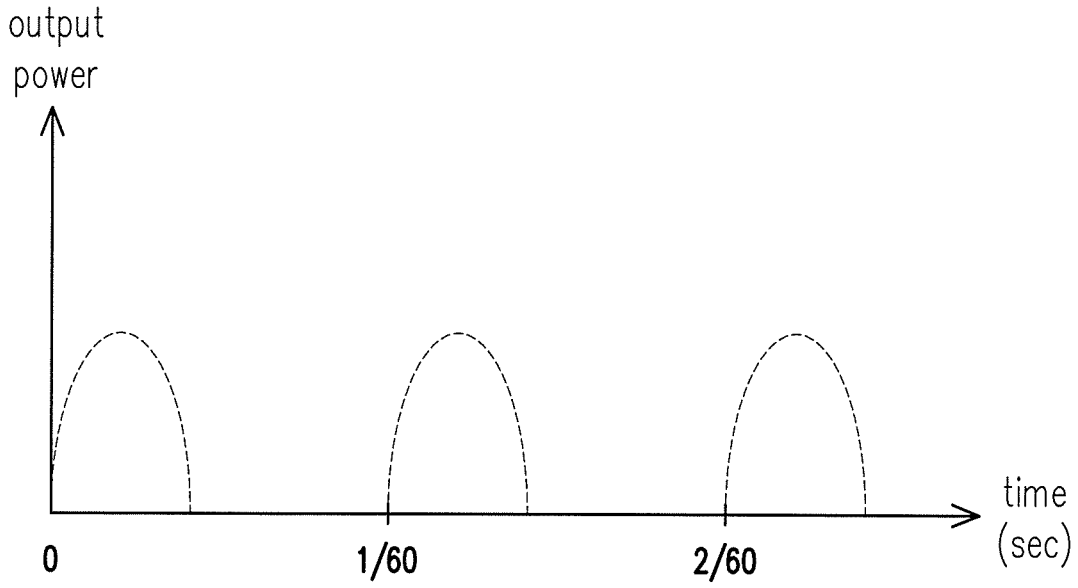
FIG. 1C illustrates the output power versus time of a microwave power supply module, in accordance with an embodiment of the present disclosure.

Referring to FIG. 1A, the microwave power supply 100 comprises a microwave power supply module 10, an alternating-current (AC) power source 11 (220V/60 Hz, assume that it is 60 Hz, but not limited thereto), and a magnetron load 12. Referring to FIG. 1B, the microwave power supply 101 comprises a microwave power supply module 20, an AC power source 21 (220V/60 Hz, assume that it is 60 Hz, but not limited thereto). The load of the microwave power supply 100 is a magnetron 22, with a magnetron filament power source 27. The microwave power supply module 20 comprises a ferro-resonant transformer 23 and a half-wave voltage doubler resonant circuit 24. The half-wave voltage doubler resonant circuit 24 is composed of a resonant capacitor 25 and a rectifier diode 26. The resonant capacitor 25 connects to an electrode of the rectifier diode 26. The other electrode of the rectifier diode 26 is grounded. A relationship of output power versus time is depicted in FIG. 1C. A horizontal axis refers to time, which is measured in seconds. A vertical axis refers to output power, which is measured in watts. The ferro-resonant transformer 23 and the resonant capacitor 25 are in resonance and are able to stabilize the output power as well as improving the power factor (or efficiency) of the microwave power supply module 10.

Figure 2A:
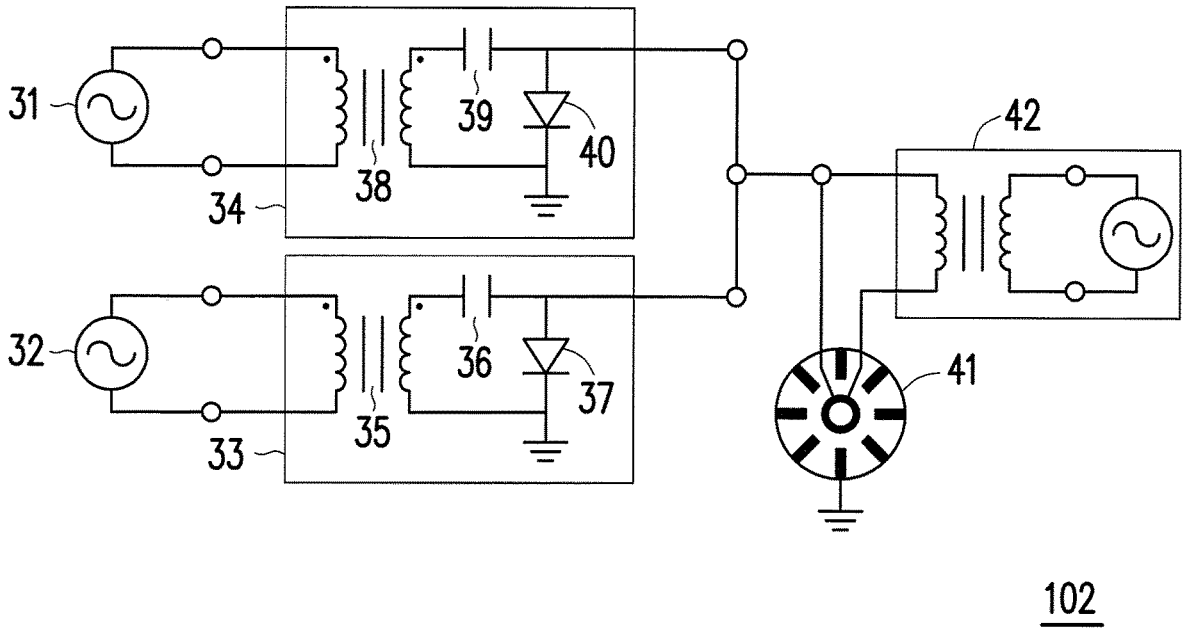
FIG. 2A is a circuit configuration illustrating a modular microwave power supply without using the isolating diodes in accordance with an embodiment of the present disclosure.
Figure 2B:
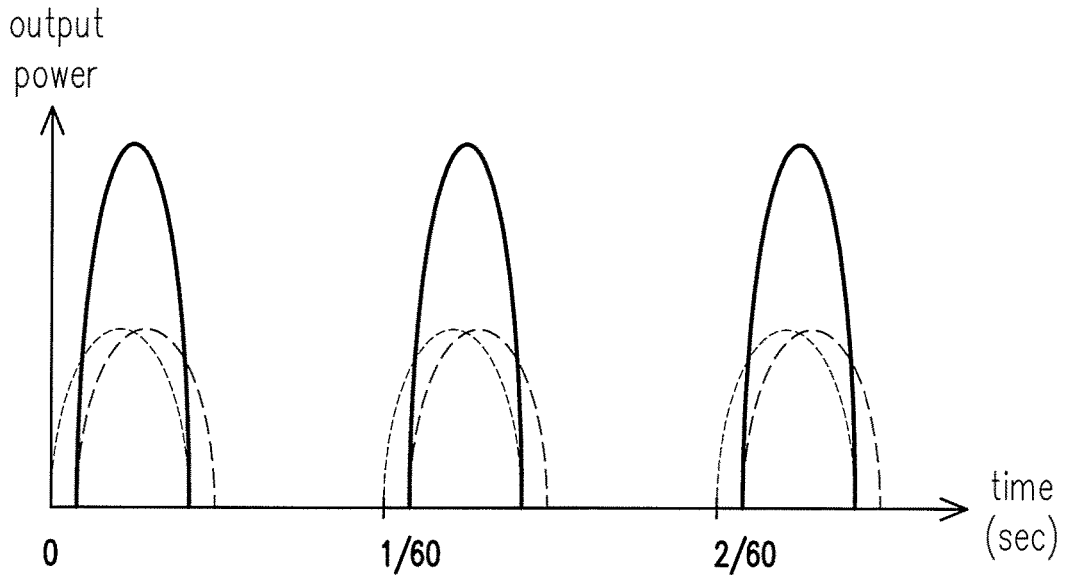
FIG. 2B illustrates a relationship of output power versus time for a modular microwave power supply without using the isolating diodes, shown in FIG. 2A, in accordance with an embodiment of the present disclosure.

FIG. 2A is a circuit configuration illustrating a modular microwave power supply 102 in accordance with an embodiment of the present disclosure. In order to acquire double output power, two single microwave power supply modules 33 and 34 directly connect in common to a magnetron load 41 without isolation. The microwave power supply 102 comprises the two single microwave power supply modules 33 and 34, two AC power sources 31 and 32. The load of the microwave power supply 102 refers to a magnetron 41 and a magnetron filament power source 42. Labels R and S refer to input terminals of the modular microwave power supply 102 connecting to the AC power sources 31 and 32. The microwave power supply module 33 comprises a ferro-resonant transformer 35, a resonant capacitor 36, and a rectifier diode 37. The microwave power supply module 34 comprises a ferro-resonant transformer 38, a resonant capacitor 39, and a rectifier diode 40. Before and after connecting in common, the output powers versus time are depicted in FIG. 2B. Assume that frequency of the AC power sources 31 and 32 is 60 Hz, but not limited thereto. A horizontal axis refers to time, which is measured in seconds. A vertical axis refers to output power, which is measured in watts. A short dash line and a long dash line refer to relationships of output power versus time before connecting in common. A solid line refers to a relationship of output power versus time after connecting in common.

A result of efficiency measurements before and after the parallel connection is described as follows. Before the parallel connection, an efficiency of the microwave power supply modules 33 or 34 separately is 90%. After the connection in common to the magnetron load 41 without isolation, an efficiency of the microwave power supply 102 is 72%. There is 18% of efficiency reduction. The efficiency reduction results from a phase difference of timing between the microwave power supply modules 33 and 34. The phase difference causes short circuits, which brings out heat dissipation of circuit. Therefore, the efficiency reduction occurs as shown in FIG. 2B. Assume that the frequency of the AC power sources 31 and 32 is 60 Hz, but not limited thereto.

Figure 3A:
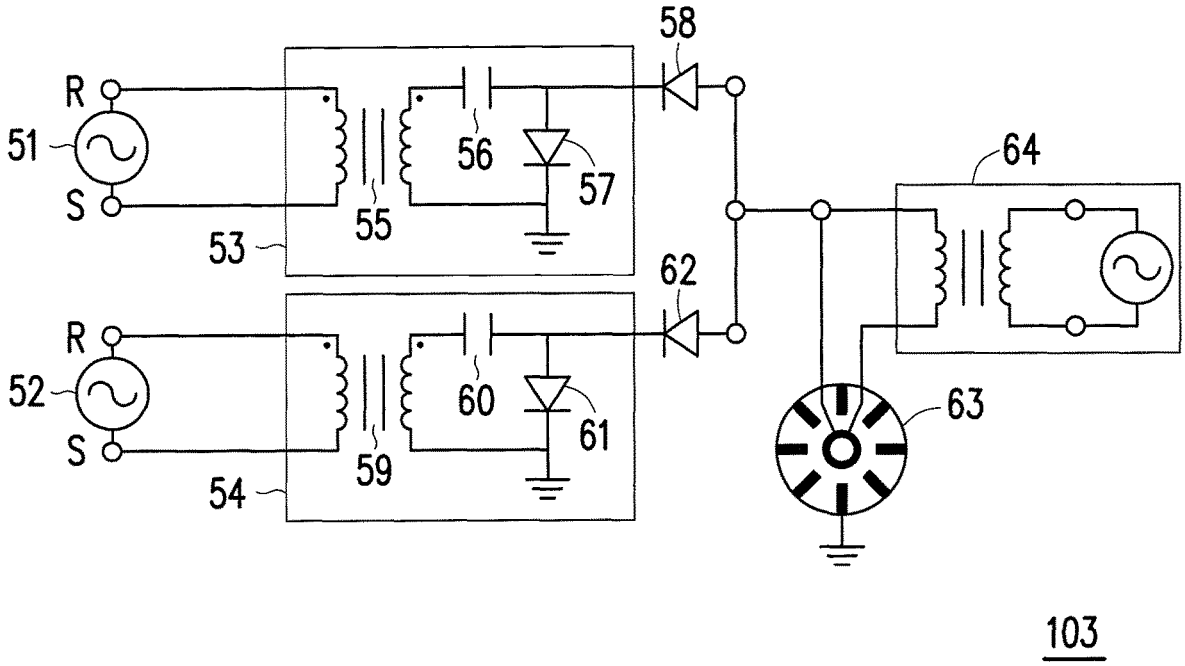
FIG. 3A is a circuit configuration illustrating a modular microwave power supply in accordance with an embodiment of the present disclosure.

FIG. 3A is a circuit configuration illustrating a modular microwave power supply 103 in accordance with an embodiment of the present disclosure. A main technique of the modular microwave power supply 103 is to eliminate efficiency reduction after a power superposition. Load terminals of two single microwave power supply modules 53 and 54 respectively connect to isolating diodes 58 and 62. That is, the microwave power supply modules 53 and 54 respectively connect to isolating diodes 58 and 62 in series. Later, the isolating diodes 58 and 62 connect parallely and then in common to a magnetron load 63. The isolating diodes 58 and 62 isolate the microwave power supply modules 53 and 54 from intervening each other. Therefore, a phase difference of the microwave power supply modules 53 and 54 will not cause short circuits. Short circuits always cause drawbacks like circuitry damages, power waste, and more heat accumulation. Therefore, the isolating diodes 58 and 62 exclude these drawbacks by isolating the two microwave power supply modules 53 and 54. The modular microwave power supply 103 comprises two single microwave power supply modules 53 and 54, and further comprises AC power sources 51 and 52. Labels R and S refer to the output terminals of the AC power sources 51 and 52 as well as the input ones of the two microwave power supply modules 53 and 54. The microwave power supply module 53 comprises a ferro-resonant transformer 55, a resonant capacitor 56, and a rectifier diode 57. The microwave power supply module 54 comprises a ferro-resonant transformer 59, a resonant capacitor 60, and a rectifier diode 61. The microwave power supply module 53 connects to one electrode of the isolating diode 58; the other electrode of the isolating diode 58 connects in common with that of the isolating diode 62 and to the magnetron load 63. Similarly, the microwave power supply module 54 connects to one electrode of the isolating diode 62; the other electrode of the isolating diode 62 connects with that of the isolating diode 58 in common and to a magnetron load 63.

Figure 3B:
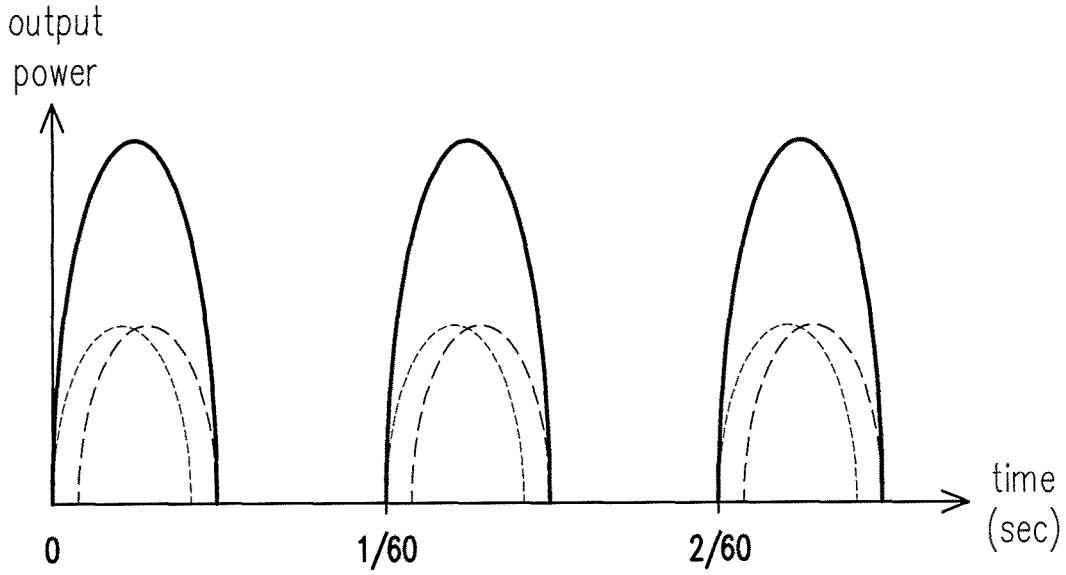
FIG. 3B illustrates the output power versus time of a modular microwave power supply shown in FIG. 3A, in accordance with an embodiment of the present disclosure.

In accordance with aforementioned, we take the microwave power supply modules 53 and 54 for example. A result of efficiency measurements before and after connecting in common is described as follows. Before connecting in common, the efficiency of the microwave power supply modules 53 or 54 separately is 90%. After isolatively connecting in common, the efficiency of the modular microwave power supply 103 is 89.5%. Only 0.5% of efficiency reduction remains. Therefore, the technique of the present disclosure decreases efficiency reduction from 18% to 0.5%. Referring to FIG. 3B, a horizontal axis refers to time, which is measured in seconds. A vertical axis refers to output power, which is measured in watts. Assume that the frequency of the AC power sources 51 and 52 is 60 Hz, but not limited thereto. A short dash line and a long dash line respectively refer to the output powers versus time of the microwave power supply modules 53 and 54 before connecting in common. A solid line refers to a relationship of combined power versus time after the two single microwave power supply modules 53 and 54 isolatively connecting in common. Although there are some phase differences between the microwave power supply modules 53 and 54, the isolating diodes 58 and 62 respectively isolate the microwave power supply modules 53 and 54 from each other. Therefore, the phase differences will not cause short circuits such that the efficiency of a single microwave power supply module is conserved. With such a simple way, power combining of two microwave power supply modules is accomplished.

Figure 4A:
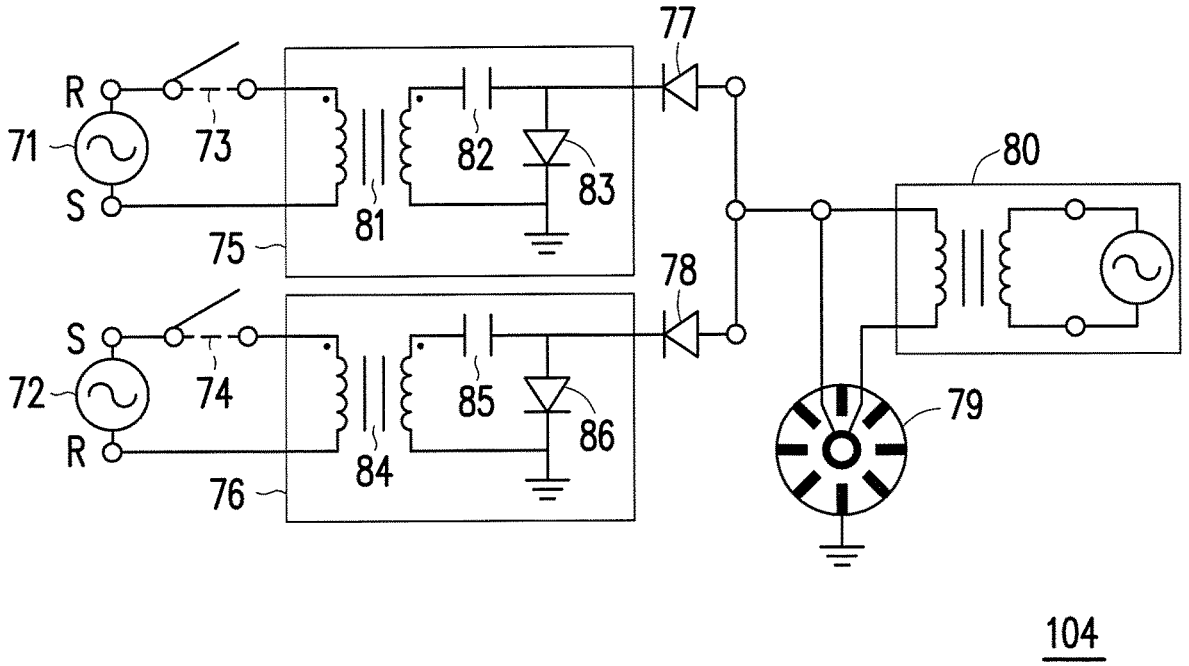
FIG. 4A is a circuit configuration illustrating a modular microwave power supply in accordance with an embodiment of the present disclosure.
Figure 4B:
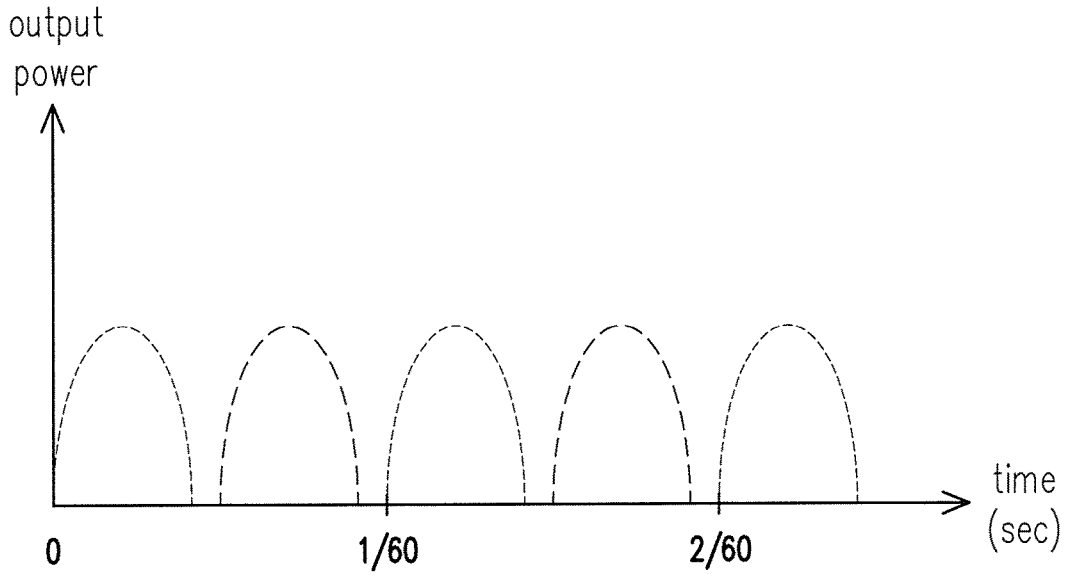
FIG. 4B illustrates the output power versus time of a modular microwave power supply shown in FIG. 4A, in accordance with an embodiment of the present disclosure.

FIG. 4A is a circuit configuration illustrating a modular microwave power supply 104 in accordance with an embodiment of the present disclosure. The modular microwave power supply 104 comprises microwave power supply modules 75 and 76, and AC power sources 71 and 72, wherein the AC power sources 71 and 72 have a gauge of 220V/60 Hz. Assume that the frequency of the AC power sources 71 and 72 is 60 Hz, but not limited thereto. Labels R and S refer to the output terminals of the AC power sources 71 and 72 as well as the input ones of the modular microwave power supply 104. Terminal sequences of the AC power sources 71 and 72 are defined as R-S and S-R respectively corresponding to two phases of source voltages, which are of 180 degrees in time sequence. Peaks of output power are unchanging, but the total output power is superposed into a full-wave output configuration other than a half-wave output configuration aforementioned. A relationship of output power versus time is depicted in FIG. 4B. A horizontal axis refers to time, which is measured in seconds. A vertical axis refers to output power, which is measured in watts. Assume that the frequency of the AC power sources 71 and 72 is 60 Hz, but not limited thereto. A short dash line and a long dash line respectively refer to output powers versus time of the microwave power supply modules 75 and 76. In addition, the output power of the microwave power supply modules 75 and 76 are able to be controlled individually and independently by relays 73 and 74, which can also be circuit breakers or other suitable switches. By independent controls of the output powers of the microwave power supply modules 75 and 76, regulation of the total power output is accomplished. The microwave power supply modules 75 and 76 respectively connect to the isolating diodes 77 and 78 in series. Later, the isolating diodes 77 and 78 connect in common to the magnetron load 79. The microwave power supply module 75 comprises a ferro-resonant transformer 81, a resonant capacitor 82, and a rectifier diode 83. The microwave power supply module 76 comprises a ferro-resonant transformer 84, a resonant capacitor 85, and a rectifier diode 86.

Figure 5:
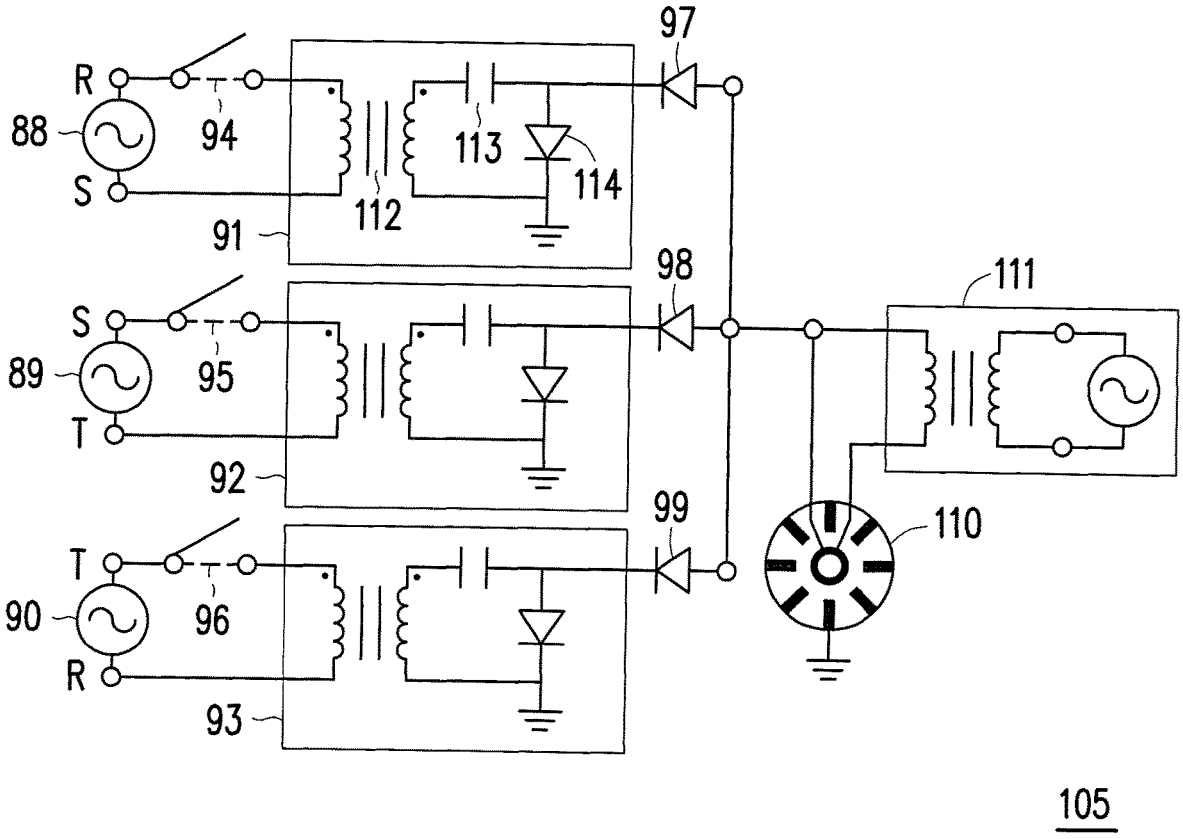
FIG. 5 is a circuit configuration illustrating a modular microwave power supply in accordance with an embodiment of the present disclosure.

FIG. 5 is a circuit configuration illustrating a modular microwave power supply 105 in accordance with an embodiment of the present disclosure. The modular microwave power supply 105 is implemented by three microwave power supply modules 91, 92, and 93, which are isolatively connected in common. Labels R, S and T refer to the output terminals of the three-phase AC power sources 88, 89, and 90 as well as the input ones of the modular microwave power supply 105. Terminal sequences of the AC power sources 91, 92 and 93 are defined as R-S and S-T and T-R respectively corresponding to three phases of source voltages, which are of 120 degrees in time sequence. In order to adjust the microwave output power, the microwave power supply modules 91, 92, and 93 respectively connect to relays 94, 95, and 96, which can be replaced by circuit breakers or other suitable switches. By independent controls of the output powers of the microwave power supply modules 91, 92, and 93, regulation of the total output power can be accomplished. The modular microwave power supply 105 microwave comprises power supply modules 91, 92, and 93, and isolating diodes 97, 98, and 99. Specially, the microwave power supply modules 91, 92, and 93 respectively connect to the isolating diodes 97, 98, and 99 in series. Later, the isolating diodes 97, 98, and 99 connect parallely in common to a magnetron load 110. The microwave power supply module 91 comprises a ferro-resonant transformer 112, a resonant capacitor 113, and a rectifier diode 114. The microwave power supply modules 91, 92, and 93 are made of the same components so that there is no need to describe again.

Figure 6A:
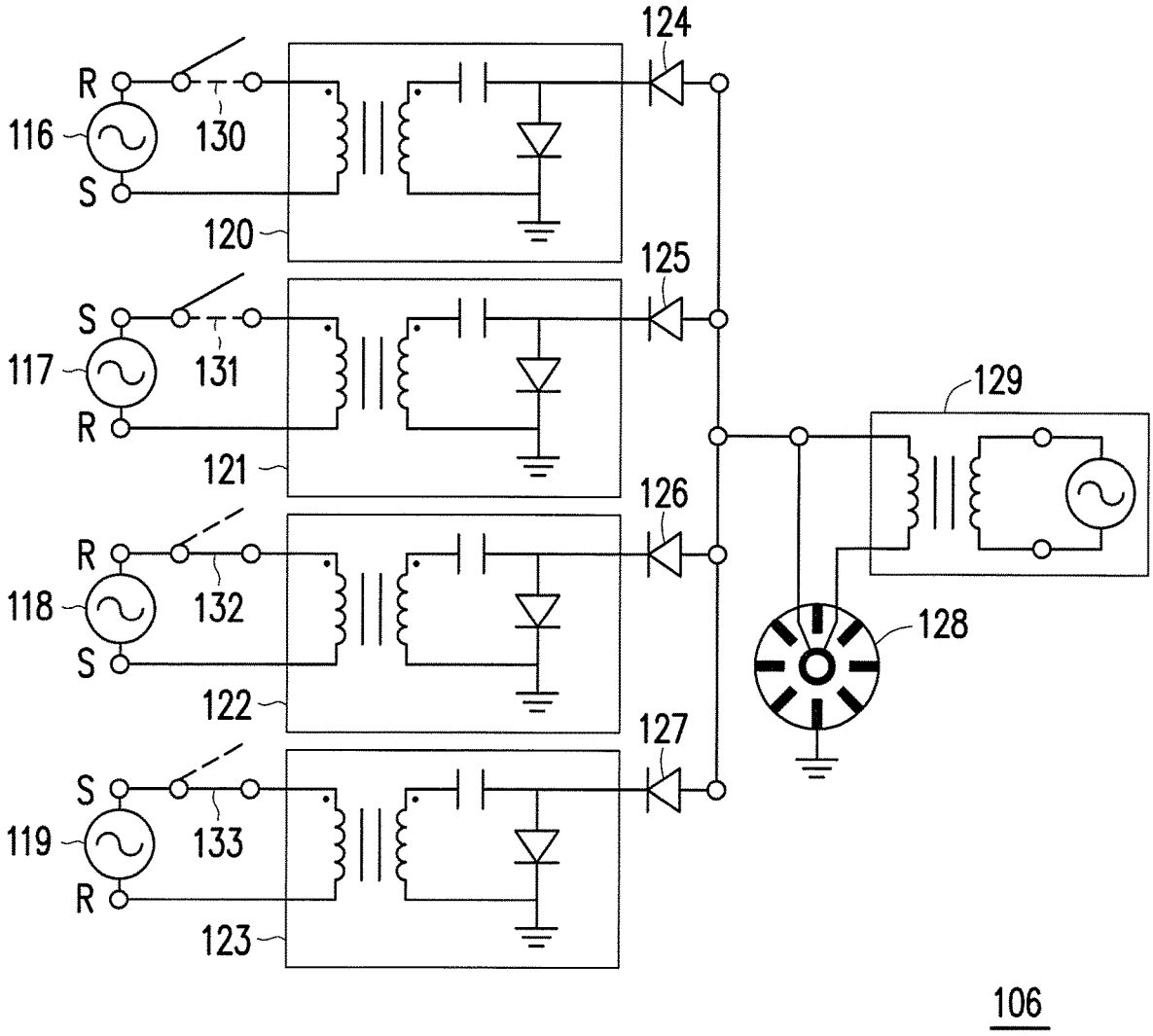
FIG. 6A and FIG. 6B are circuit configurations illustrating two modular microwave power supplies implemented in different compositions of alternating-current (AC) power sources, respectively, in accordance with embodiments of the present disclosure.
Figure 6B:
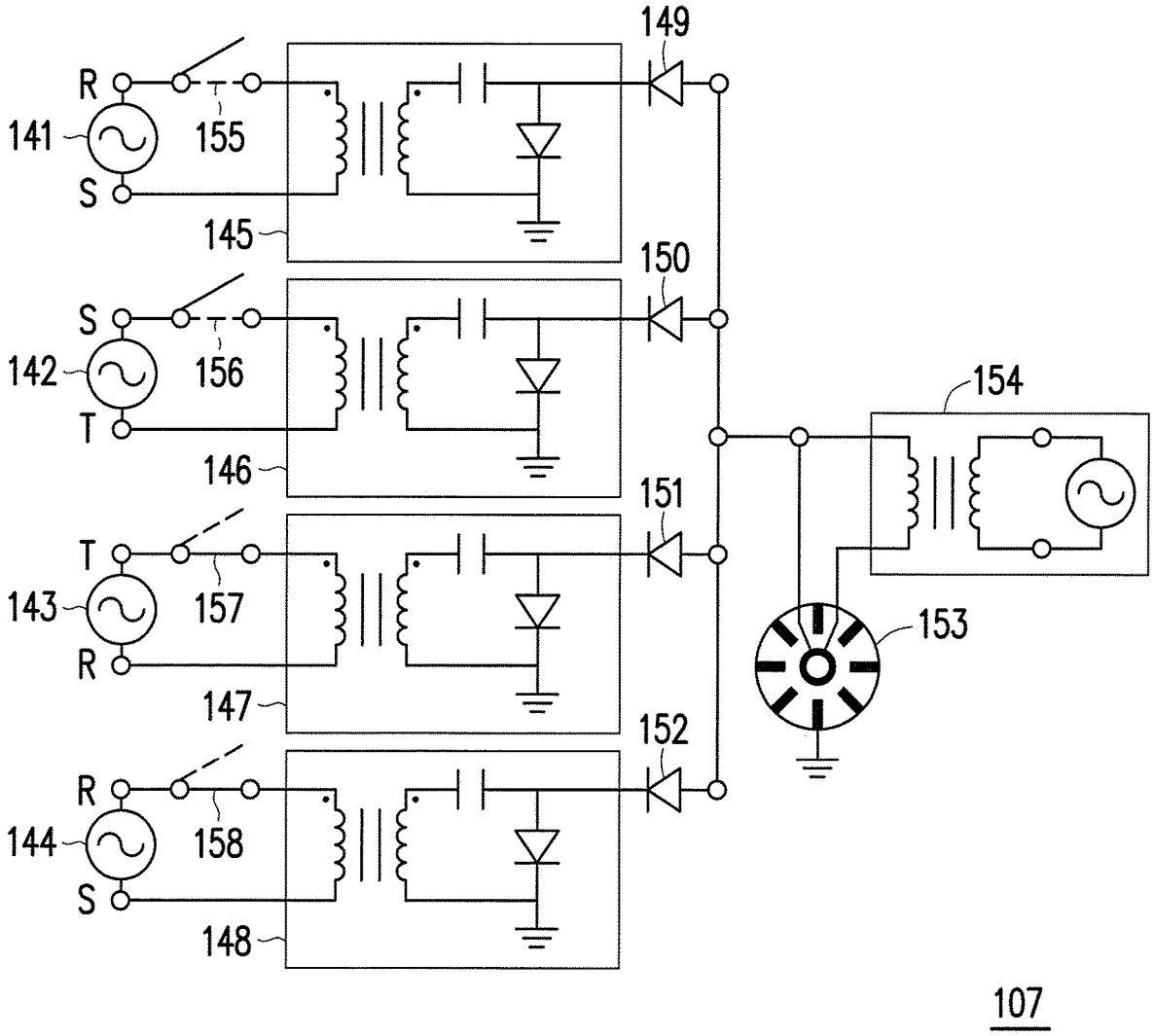

FIG. 6A and FIG. 6B are circuit configurations illustrating two modular microwave power supplies 106 and 107, respectively, in accordance with embodiments of the present disclosure. In this embodiment, four single microwave power supply modules are isolatively connected in common. Labels R, S and T refer to the output terminals of the three-phase AC power sources 116, 117, 118, 119, 141, 142, 143, 144 as well as the input ones of the modular microwave power supplies 106 and 107. An embodiment of FIG. 6A is a combination of two embodiments of FIG. 4A. The modular microwave power supply 106 comprises AC power sources 116, 117, 118, and 119, microwave power supply modules 120, 121, 122, and 123, relays 130, 131, 132, and 133, isolating diodes 124, 125, 126, and 127. The microwave power supply modules 120, 121, 122, and 123 have the same structure as the microwave power supply module 91. Using isolating diodes 124, 125, 126 and 127, a combination of four microwave power supply modules 120, 121, 122 and 123 into the modular microwave power supply 106 excludes the efficiency reduction and acquires combined-power output.

Referring to the circuit configuration of FIG. 6B, the modular microwave power supply 107 is implemented by the modular microwave power supply 105 of FIG. 5 and a single microwave power supply module 152, which are isolatively connected in common to a magnetron load 153. The modular microwave power supply 107 comprises AC power sources 141, 142, 143, and 144, microwave power supply modules 145, 146, 147, and 148, relays 155, 156, 157, and 158, isolating diodes 149, 150, 151. The microwave power supply modules 145, 146, 147, and 148 have the same structure as the ones of the microwave power supply module 91. Specially, terminal sequences of the AC power sources 141, 142, 143, and 144 are defined as R-S, S-T, T-R, and R-S. Using isolating diodes 149, 150, 151 and 152, a combination of four microwave power supply modules 145, 146, 147 and 148 into the modular microwave power supply 107 excludes the efficiency reduction and acquires combined-power output.

Figure 7:
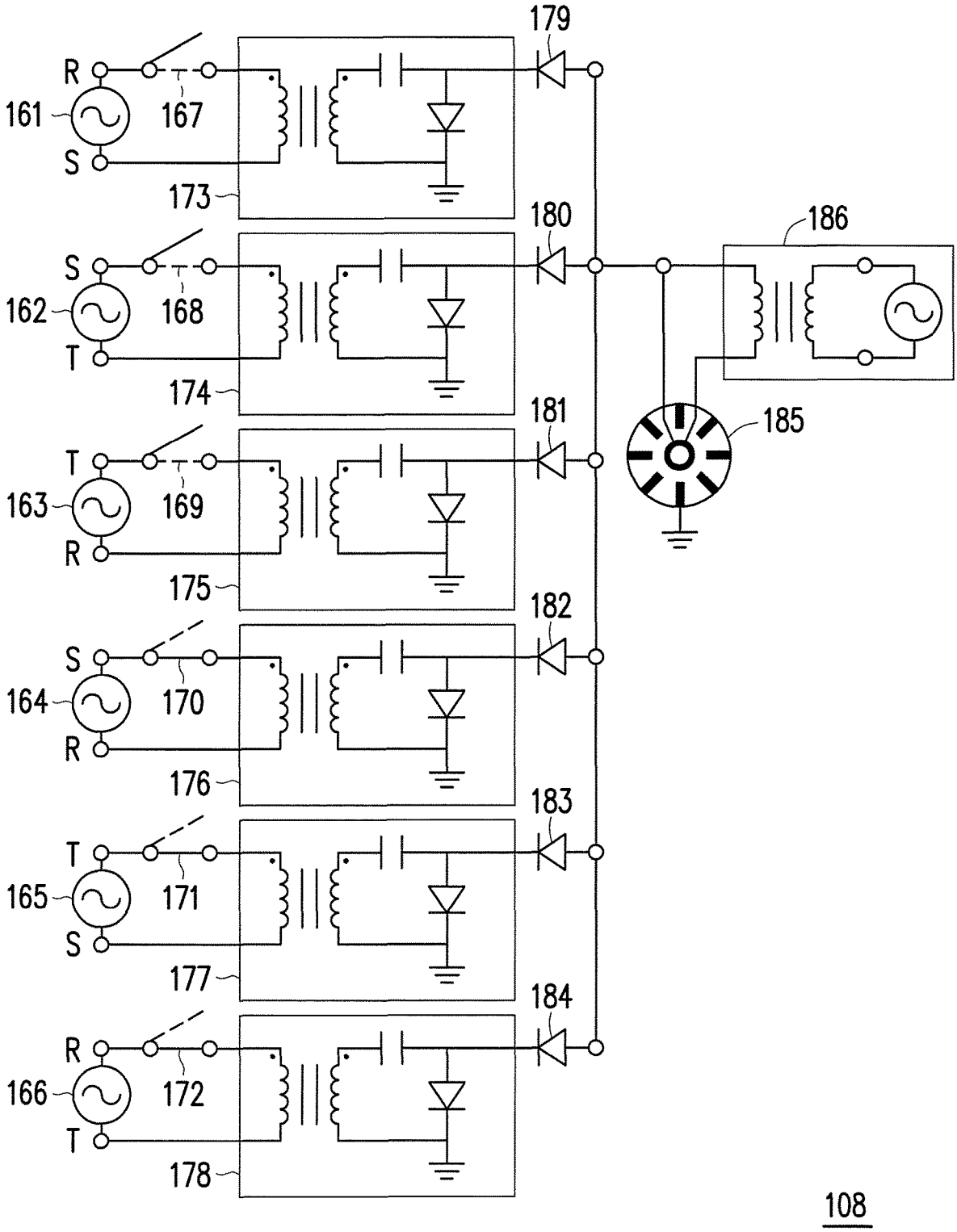
FIG. 7 is a circuit configuration illustrating a modular microwave power supply in accordance with an embodiment of the present disclosure.

FIG. 7 is a circuit configuration illustrating a modular microwave power supply 108 in accordance with an embodiment of the present disclosure. The modular microwave power supply 108 is implemented by combining two circuit configurations of the modular microwave power supply 105 shown in FIG. 5. In FIG. 7, six single microwave power supplies are isolatively connected in common to a magnetron load 185. The modular microwave power supply 108 comprises AC power sources 161, 162, 163, 164, 165, and 166, microwave power supply modules 173, 174, 175, 176, 177, and 178, relays 167, 168, 169, 170, 171, and 172, and isolating diodes 179, 180, 181, 182, 183. The microwave power supply modules 173, 174, 175, 176, 177, and 178 have the same structure as the microwave power supply module 91. Specially, terminal sequences of the AC power sources 161, 162, 163, 164, 165, and 166 are defined as R-S, S-T, T-R, S-R, T-S, and R-T respectively corresponding to six phases of source voltages, which are of 60 degrees in time sequence. Using isolating diodes 179, 180, 181, 182, 183 and 184, a combination of five microwave power supply modules 173, 174, 175, 176, 177 and 178 into the modular microwave power supply 108 excludes the efficiency reduction and acquires combined-power output.

In another embodiment, by appropriately combining above embodiments, the present disclosure achieves a modular microwave power supply composed of any number of single microwave power supply modules that are isolatively connected in common using the corresponding number of isolating diodes.

Figure 8A:
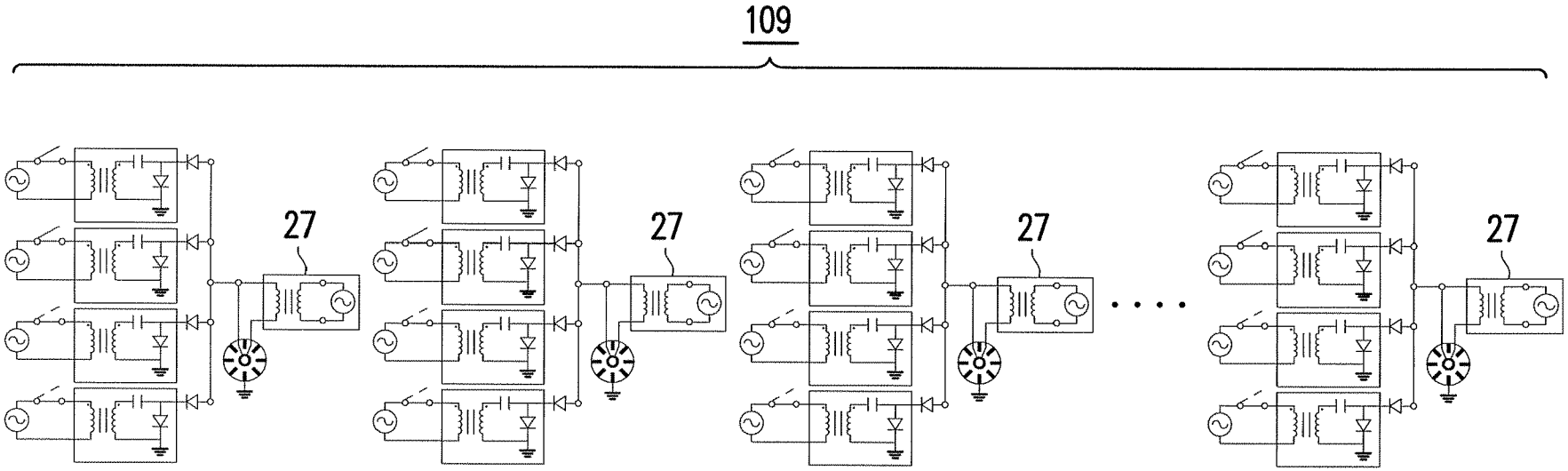
FIG. 8A and FIG. 8B are circuit configurations illustrating a plurality of modular microwave power supplies and their application, respectively, in accordance with embodiments of the present disclosure.
Figure 8B:
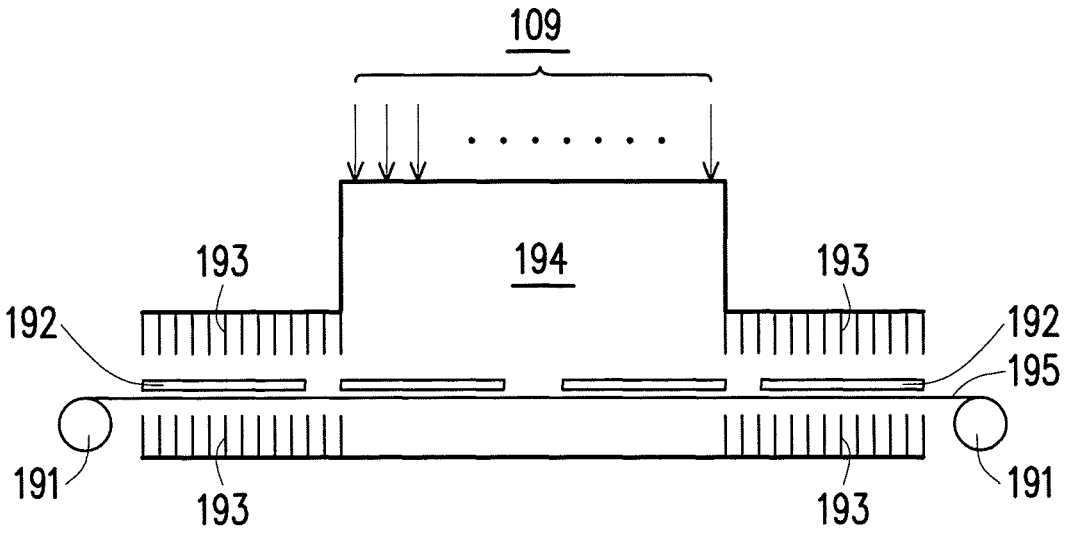

In another embodiment, the present disclosure relates to a plurality of the modular microwave power supplies so as to perform microwave heating with an unlimited total power output. FIG. 8A and FIG. 8B are circuit configurations illustrating a plurality of modular microwave power supplies 109 and their application, respectively, in accordance with embodiments of the present disclosure. A plurality of modular microwave power supplies 109 are utilized to heat up an object in a heating chamber 194 by microwave. Referring to FIG. 8B, the plurality of modular microwave power supplies 109 correspond to and provide microwave power into the heating chamber 194. Rolls 191 and a conveyer 195 are configured to transfer objects 192 for heating. Filters 193 are equipped at both inward and outward sides of the conveyer 195.

In brief, the present disclosure solves a problem of accumulated-heat dissipation and keeps high efficiency of microwave power supplies with high-power output. The present disclosure combines a plurality of microwave power supply modules into a modular microwave power supply with combined-power output. The present disclosure will not change a ratio of volume to area of the transformers therein after upgrading the output power of the modular microwave power supply, so as to conserve the original accumulated-heat dissipating ability as well as the high efficiency of the microwave power supply modules.

In an embodiment, a number of the plurality of microwave power supply modules is 2, and a number of the plurality of isolating diodes is 2.

In an embodiment, a number of the plurality of microwave power supply modules is 3, and a number of the plurality of isolating diodes is 3.

In an embodiment, a number of the plurality of microwave power supply modules is 4, and a number of the plurality of isolating diodes is 4.

In an embodiment, a number of the plurality of microwave power supply modules is 5, and a number of the plurality of isolating diodes is 5.

In an embodiment, a number of the plurality of microwave power supply modules is 6, and a number of the plurality of isolating diodes is 6.

In an embodiment, a number of the plurality of microwave power supply modules is N, and a number of the plurality of isolating diodes is N, wherein the N is a positive integer and equal to or greater than 7.

In an embodiment, the plurality of microwave power supply modules and the plurality of isolating diodes are configured as a full-wave rectification or a half-wave rectification.

In an embodiment, output power of each of the plurality of microwave power supply modules is configured to be discrete and independently controlled.

In an embodiment, the plurality of microwave power supply modules correspond to a heating chamber, which is configured to heat up an object in the heating chamber by microwave.

It will be apparent to those skilled in the art that various modifications and variations can be made to the disclosed embodiments. It is intended that the specification and examples be considered as exemplars only, with a true scope of the disclosure being indicated by the following claims and their equivalents.

What is claimed is:

1. A modular microwave power supply, comprising:

a plurality of microwave power supply modules, wherein each of plurality of microwave power supply modules further comprises:

a ferro-resonant transformer;

a resonant capacitor which connects in series with a secondary winding of the ferro-resonant transformer;

a rectifier diode which is shunt with the resonant capacitor; and an isolating diode which connects in series with the rectifier diode, wherein the isolating diodes of the plurality of microwave power supply modules are all connected in common to a magnetron load, and a number of the plurality of microwave power supply is N, where N is a positive integer greater than 4, wherein each of the plurality of microwave power supply modules is connected to an AC power source, and the plurality of microwave power supply modules is configured to be switchable between a full-wave rectification and a half-wave rectification by changing phases of at least M number of source voltages corresponding to the AC power sources, where M is a positive integer larger than 1 and less than N.

2. The modular microwave power supply of claim 1, wherein an output power of each of the plurality of microwave power supply modules is configured to be individually and independently controlled.

3. The modular microwave power supply of claim 1, wherein the plurality of microwave power supply modules corresponds to a heating chamber, which is configured to heat up an object in the heating chamber by microwave.

* * * * *